US006021299A

United States Patent [19]

Hansburg et al.

[11] Patent Number: 6,021,299

[45] Date of Patent: Feb. 1, 2000

[54] PRECISION BLADE FOR METERING TONER ON DEVELOPING ROLLER

[75] Inventors: E. Michael Hansburg, Wayne; Victor Italiano, Glenmoore, both of Pa.

[73] Assignee: Oki Data America, Inc., Mt. Laurel, N.J.

[21] Appl. No.: 09/321,055

[22] Filed: May 27, 1999

[51] Int. Cl.[7] ..... G03G 15/08

[52] U.S. Cl. ..... 399/284

[58] Field of Search ..... 399/284, 274

[56] References Cited

U.S. PATENT DOCUMENTS

| | | |
|---|---|---|
| 3,552,850 | 1/1971 | Royka et al. . |
| 3,918,807 | 11/1975 | Hwa . |
| 4,247,196 | 1/1981 | Ogawa et al. . |
| 4,469,434 | 9/1984 | Yamazaki et al. . |
| 4,908,291 | 3/1990 | Fuma et al. . |
| 4,920,916 | 5/1990 | Mizuno et al. . |
| 5,587,551 | 12/1996 | Ikegawa et al. . |
| 5,587,776 | 12/1996 | Watabe et al. . |
| 5,702,812 | 12/1997 | Bracken et al. . |
| 5,722,021 | 2/1998 | Iwao . |
| 5,722,022 | 2/1998 | Park . |
| 5,752,146 | 5/1998 | Sato . |
| 5,805,966 | 9/1998 | Yamada . |

*Primary Examiner*—William Royer
*Assistant Examiner*—Greg Moldafsky
*Attorney, Agent, or Firm*—Akin, Gump, Strauss, Hauer, & Feld, L.L.P.

[57] ABSTRACT

A blade for metering toner on a developing roller of an electrophotographic printer is made of a resilient material and includes a first elongated segment, a second elongated segment which extends generally perpendicular to the first segment and a transition portion which connects the first segment and the second segment. The transition portion has a thickness and a length. The transition portion is generally tangent to a surface of the developing roller and includes a groove which is obliquely cut therein in a direction generally opposite from a direction of rotation of the developing roller. The groove forms a movable lip in the transition portion and extends generally toward the second segment a distance approximately one half the thickness of the transition portion. The lip further has a length which extends the length of the transition portion. The lip contacts toner on the surface of the developing roller proximate to the groove and is elastically displaceable by the toner with respect to the first segment by the thickness of the groove.

6 Claims, 2 Drawing Sheets

PRECISION BLADE FOR METERING TONER ON DEVELOPING ROLLER

BACKGROUND OF THE INVENTION

The present invention relates to a metering blade for use in an electrophotographic apparatus, such as a photocopier or an LED or laser printer.

In electrophotography, dry toner is electrostatically transferred from a developing roller to a photoreceptor, and then to a printing substrate, generally paper or the like to provide a printed image on the substrate. It is vitally important that the desired quantity of toner be transferred to the photoreceptor during the printing process. A critical element in accomplishing this goal is applying a very uniform controlled layer of toner on the developing roller. A metering blade is commonly used as a tool to remove excess toner from the developing roller and to level the toner layer which electrostatically adheres to the roller.

Currently used metering blades are made from thin flexible metal which is affixed to the printer housing in a position which causes the blade to be slightly bent when installed against the surface of the developing roller, storing energy in the blade. The stored energy in the bent blade applies a small pressure to the nip which is formed between the metering blade and the developing roller. Because the blade is very thin and flexible, small deviations in the position of the blade relative to the developing roller have only a very small effect on the pressure in the nip. The flexibility of the metering blade also mitigates the need for precise parallelism between the nip and the axis of the developing roller. The pressure in the nip and its uniformity are controlled by design along with other factors to produce the proper toner layer thickness on the roller.

It is desirable to have the metering blade lay against the developing roller in a manner such that the end of the blade close to the nip is "downstream" from the nip, i.e. past the nip in the direction of rotation of the developing roller. The blade/roller configuration is commonly referred to as the "wiping position".

However, because toner is generally moved to the area of the developing roller by up to two rotating rollers, there is no room to put the metering blade in this preferred position. The metering blade must be applied in a direction at which a free end of the blade opposes the motion of the developing roller. This undesirable configuration is commonly referred to as the "doctoring" position. This configuration does not allow precise control of nip forces, and thus, cannot precisely meter the toner on the developing roller.

The problem of the metering blade facing the wrong direction (the "doctoring" position) is partially compensated for by putting a generally orthogonal bend in the metering blade near its free end, such as the metering blade disclosed in U.S. Pat. No. 5,587,551. This bend eliminates the sharp edge that could dig into and jam the developing roller. However, the flexibility of the thin blade in the vicinity of the bend and any lack of flatness that could have been mitigated by the flexibility is virtually eliminated by the bend. Also, end effects exist at both longitudinal ends of the blade and stress differentials exist in the area of the bend that contribute to a lack of flatness in the blade. This lack of flatness leads to a variation in the thickness of the toner layer along the length of the developing roller. This, in turn, can lead to process direction streaks in the printed image, reducing print quality. Secondary machining and polishing of the blade in the nip area and increased cylindricity tolerance requirements on the developing roller can improve uniformity, but these are very expensive hit-or-miss solutions.

It would be beneficial to provide a more compliant metering surface that is less subject to rigorous flatness requirements, to provide a flatter metering surface by reducing stress differentials at edges of the bend, and to provide a "wiper" blade type nip from a blade that is forced by geometrical considerations to be in a "doctor" blade configuration. The present invention satisfies these needs.

BRIEF SUMMARY OF THE INVENTION

The present invention is a blade for metering toner on a developing roller of an electrophotographic printer. The blade is made of a resilient material and comprises a first elongated segment, a second elongated segment which extends generally perpendicular to the first segment and a transition portion which connects the first segment and the second segment. The transition portion has a thickness and a length. The transition portion is generally tangent to a surface of the developing roller and includes a groove which is obliquely cut therein in a direction generally opposite from the direction of rotation of the developing roller. The groove forms a movable lip in the transition portion and extends generally toward the second segment a distance approximately one half the thickness of the transition portion. The lip further has a length which extends the length of the transition portion. The lip contacts toner on the surface of the developing roller proximate to the groove and is elastically displaceable by the toner with respect to the first segment by the thickness of the groove.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
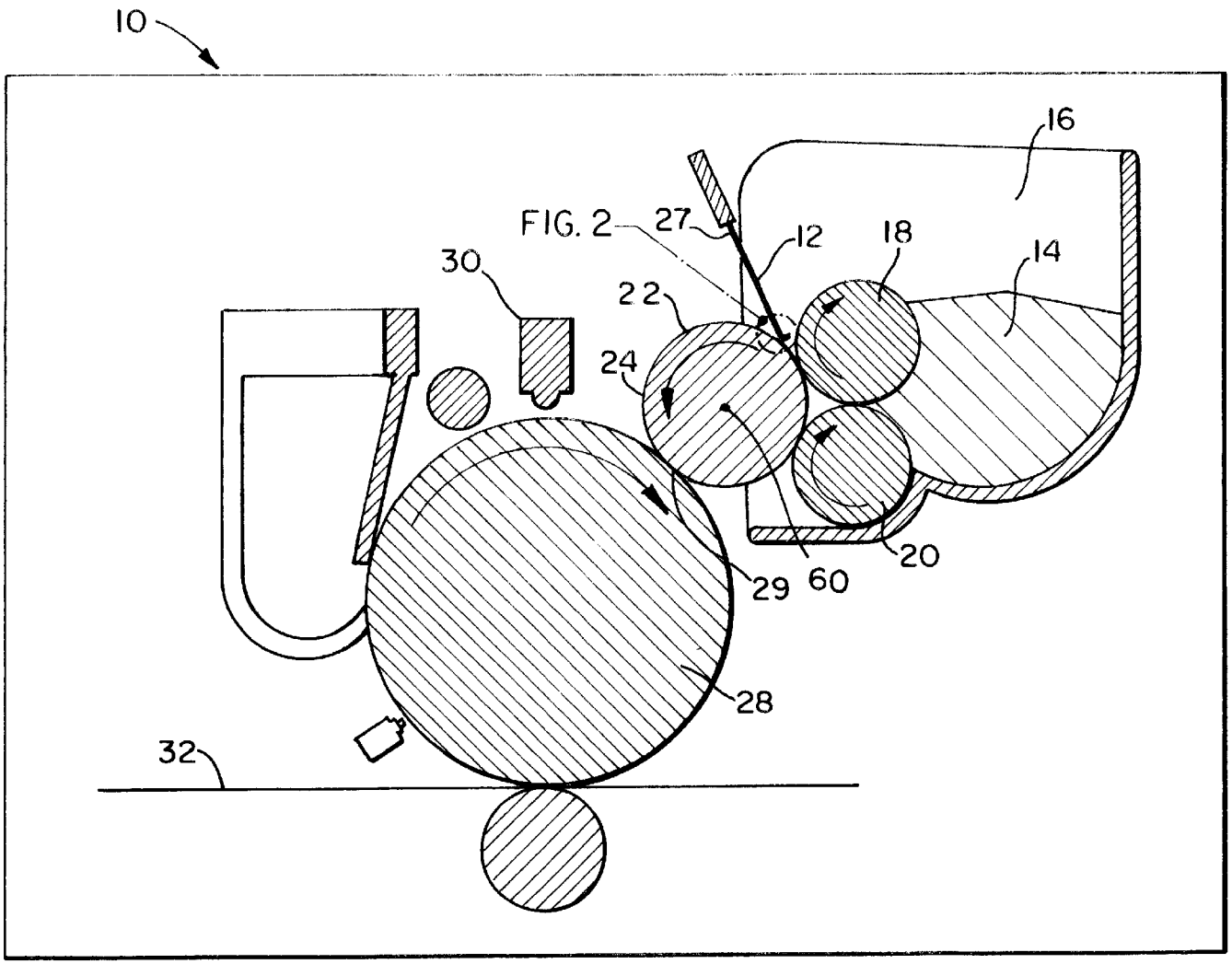
FIG. 1 is a cross-sectional view of an electrophotographic printer showing the location of a metering blade according to a preferred embodiment of the present invention.

In the drawings, like numerals are used to indicate like elements throughout the several figures. Referring to FIG. 1, a cross-sectional view of an electrophotographic printer 10, such as an LED or laser printer, using a toner metering blade 12 in accordance with a preferred embodiment of the present invention, is shown. Toner 14, in the form of fine granular particles, is contained in a reservoir 16 in the printer 10, and is fed by two rotating feed rollers 18, 20 (each rotating clockwise in FIG. 1) to a counter-rotating developing roller 22 (rotating counter-clockwise in FIGS. 1 and 2). The feed rollers 18, 20 are preferably made from a foam material with cells which hold a significant quantity of toner 14 for transfer to the developing roller 22. The developing roller 22 is electrically charged to attract and hold a layer of the toner 14 received from the feed rollers 18, 20 along a cylindrical outer surface 24 of the developing roller 22. The thickness of the toner 14 at any given location along the cylindrical outer surface 24 of the developing roller 22 depends upon the local intensity of electrical charges in the area, the geometry of the particles of the toner 14, and natural adhesive surface forces between the toner 14 and the developing roller 22.

Figure 2:
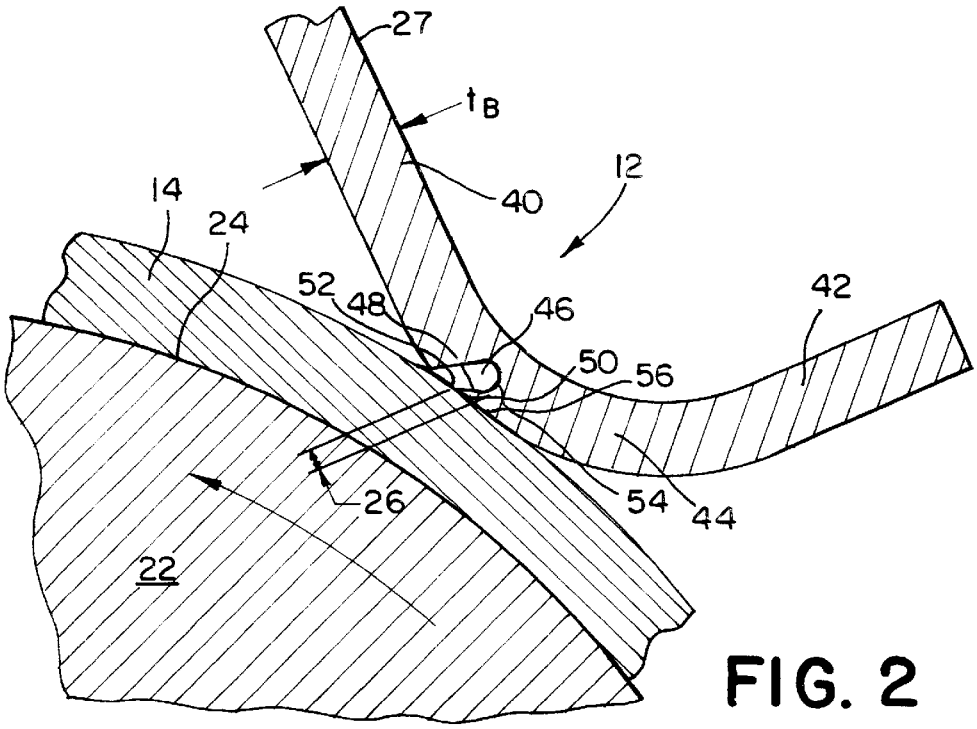
FIG. 2 is a greatly enlarged cross-sectional view of the metering blade of FIG. 1 installed proximate to a developing roller.

Referring now to FIG. 2, the metering blade 12 is biased against the surface 24 of the developing roller 22 to provide a contact area in the form of a nip 26 which rides on the layer of toner 14 which has adhered to the surface 24 of the developing roller 22. Referring back to FIG. 1, the blade 12 is configured in the "doctoring" position, with the blade 12 attached to a frame or other structural member (not shown) of the printer 10 at an attached end 27, removed from the nip 26.

The metering blade 12 meters or adjusts the toner 14 on the developing roller 22. The arrangement of the metering blade 12 on the developing roller 22 allows only a thin and uniform layer of toner 14 to pass between the blade 12 and the developing roller 22 as the developing roller 22 rotates past the blade 12. The thin layer of toner 14 is then carried by the rotation of the developing roller 22 to a photoreceptor drum 28, which is electrically charged opposite to the charge of the toner 14 on the developing roller 22 in predetermined locations by an optical printing head 30 corresponding to a latent image on the photoreceptor drum 28. As the charged areas of the photoreceptor drum 28 pass through a photoreceptor drum/developing roller nip 29, toner 14 that contacts the charged areas of the photoreceptor drum 28 is strongly attracted to those areas and is picked up by and retained on the surface 24 of the photoreceptor drum 28. The toner 14 picked up by the photoreceptor drum 28 is then transferred and fused in a known manner to a printing medium 32 such as paper, producing the desired printed document. Complete details of structure and operation of the components, other than the metering blade 12, of the electrophotographic printer 10 are well known and are available from various sources, including the manufacturer of such printer 10.

Figure 3:
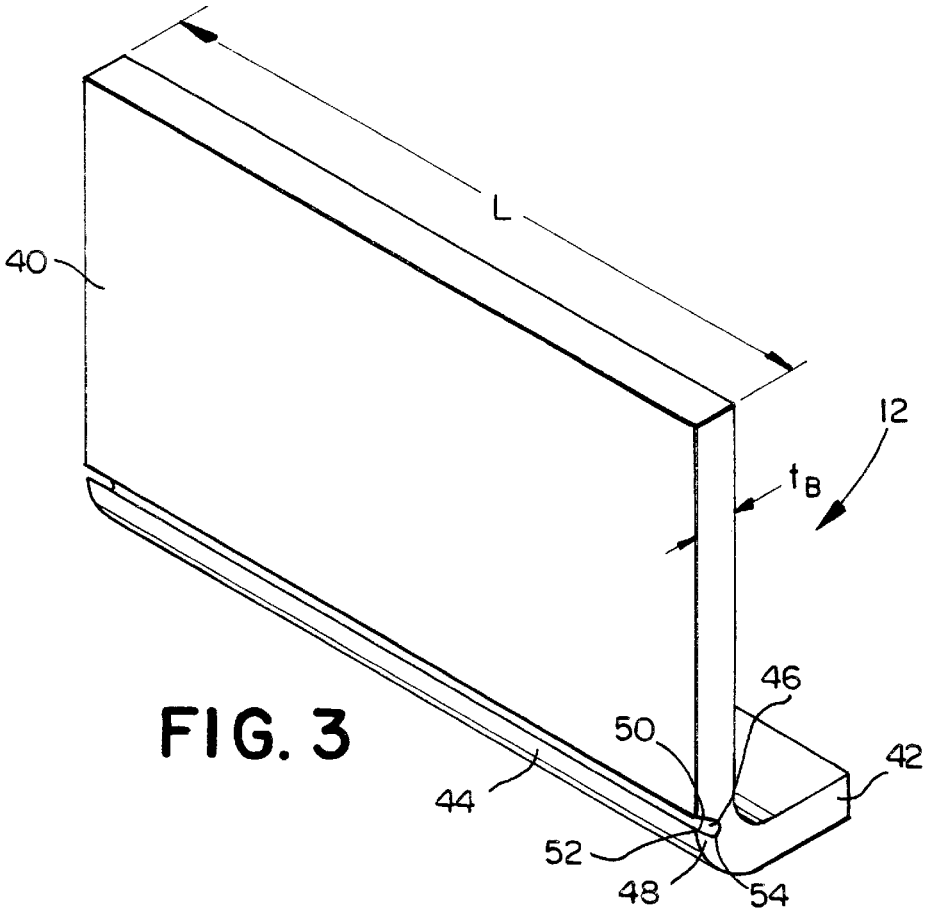
FIG. 3 is a perspective view of the metering blade of FIG. 1.

Referring now to FIGS. 2 and 3, the metering blade 12 according to the preferred embodiment of the present invention comprises a first elongated segment 40 which has a predetermined thickness "$t_B$" and which extends a length "L" at least as long as the length of the developing roller 24. The first elongated segment 40 is attached to a frame or other structural member (not shown) of the printer 10 at the attached end 27. The metering blade 12 further comprises a second elongated segment 42 which has a predetermined thickness, generally the same thickness $t_B$ as the first elongated segment 40, and which also extends the length L of the blade 12. Preferably, the thickness $t_B$ of the metering blade 12 is between approximately 0.06 and 0.2 mm. The second elongated segment 42 extends generally perpendicular to the first elongated segment 40, forming a generally "L-shaped" blade. The L-shape of the blade 12 is generally formed by bending part of a straight blade generally uniformly throughout the width of the transition portion 44, with the first elongated segment 40 forming a longer leg of the "L" and the second elongated segment 42 forming a shorter leg of the "L". However, although the second elongated segment 42 is preferably perpendicular to the first elongated segment 40, those skilled in the art will realize that the first and second elongated segments 40, 42 can be at other angles greater or less than perpendicular.

The blade 12 further comprises a transition portion 44 between the first elongated segment 40 and the second elongated segment 42 along the length L of the blade 12. The transition portion 44 has a thickness which is generally the thickness $t_B$ of the first elongated segment 40 and the second elongated segment 42. Although, as shown in FIG. 1, the transition portion 44 appears to be a sharp 90° angle, the enlarged views of the blade 12 shown in FIGS. 2 and 3 show that the transition portion 44 is in fact curved.

As shown in FIG. 2, when the blade 12 is installed in the electrophotographic printer 10, the transition portion 44 is located generally tangent to the surface 24 of the developing roller 22. However, the curved transition portion 44 does not provide a sharp edge as required to properly meter the toner 14 on the surface 24 of the developing roller 24. To compensate for the curvature of the transition portion 44, the transition portion 44 includes a groove 46 which is obliquely cut therein. Preferably, the groove 46 is formed by a negative focused precision laser cutting machine (not shown), diamond milling, or equivalent/superior cutting machine technology, which is well known to those skilled in the art. The groove 46 extends in a direction generally opposite from the direction of rotation of the developing roller 22 and forms a movable lip 48 in the transition portion 44 which extends between a free first end 50 which includes an edge 52 and a second end 54 which comprises a part of the transition portion 44. The groove 46 and the lip 48 extend toward the second elongated segment 42 a distance approximately one half of the thickness $t_B$ of the transition portion 44 and the groove 46 and the lip 48 have each a length which extends the entire length of the transition portion 44. Cutting into the blade 12 at the transition portion 44 causes the lip 48 to straighten out slightly and slightly protrude from the transition portion 44, forming the edge 52 in a precision, razor-like fashion.

As shown in FIG. 2, the lip 48 contacts the toner 14 on the surface 24 of the developing roller 22 along the edge 52 of the lip 48 and the groove 46, forming a nip 56 between the toner 14 and the edge 52 of the lip 48 along the nip 26. The contact between the lip 48 and the toner 14 on the surface 24 of the developing roller 22 extends generally linearly along the length of the lip 48. The developing roller 22, and thus, the toner 14 which is adhered to the developing roller 22, rotates in a direction generally from the second end 54 of the lip 48 toward the first end 50 (and the edge 52) of the lip 48 (counter-clockwise as seen in FIG. 2). The lip 48 thereby levels the toner 14 on the developing roller 22 as the developing roller 22 rotates past the blade 12, reducing the amount of toner 14 on the developing roller 22 to a single uniform layer of toner 14, which rotates on the developing roller 22 beyond the lip 48. Because the lip 48 is biased against the surface 24 of the developing roller 22 and is very flexible, the lip 48 can better conform to the surface 24 of the developing roller 22, resulting in a more uniform layer of toner 14.

The edge 52 formed by the groove 46 is "downstream" from the nip 56, converting the blade 12 from one in the undesired "doctoring" position to one that is, at least functionally, in the preferred "wiping" position. Thus, there is no danger of jamming the blade 12 into the developing roller 22. Excess toner 14 which is scraped from the developing roller 22 builds up against the lip 48. Some of the excess toner 14 which is scraped from the developing roller 22 is redistributed as the developing roller 22 rotates, filling in any bare spots on other locations on the developing roller 22 which may not be carrying sufficient quantities of toner 14. The remaining toner 14 which is scraped from the developing roller 22 remains against the lip 48 until a quantity of toner 14 has built up that is too thick for the outermost particles of the toner 14 to remain in place. This toner 14 falls onto the developing roller 22 downstream of the nip 26 and is returned to the nip 26 as the developing roller 22 rotates.

The rate of transfer of the toner 14 from the reservoir 16 to the blade 10 is significantly greater than the amount of toner 14 that is being metered by the blade 10. The excess toner 14 generally builds up downstream of the nip 26 to a point where some of the excess toner 14 is carried from build up downstream of the nip 26 by the feed roller 18. Some of the toner 14 falls from the feed roller 18 into the reservoir 16 as the feed roller 18 rotates. Some of the toner 14 remains on the feed roller 18 and continues on the feed roller 18 to engage the developing roller 22 in a subsequent revolution of the feed roller 18.

Additionally, although the blade 12 is installed in the printer 10 so that the length of the blade 12 is generally parallel to a longitudinal axis 60 of the developing roller 22, even a slight deviation in the parallelism between the developing roller axis 56 and the blade 12 can adversely affect the performance of the blade 12. To remedy such potential problems, the blade 12 is made from a resilient material, preferably spring-type stainless steel, although those skilled in the art will realize that other suitable resilient materials can be used as well. The resiliency of the material enables the blade 12 to bend to conform to the contour of the developing roller 22, and then return to an unbent condition. As the developing roller 22 rotates and as the blade 12 is biased toward the developing roller 22, the lip 48 is elastically displaceable by the developing roller 22 and the toner 14 thereon with respect to the first elongated segment 40 by the thickness of the groove 46. The elastic displaceability compensates for any lack of flatness along the length of the lip 48, and ensures near uniform layering of toner 14 on the developing roller 22 along the length of the lip 48.

Additionally, although the developing roller 22 generally appears smooth, slight irregularities in the surface, on the order of just a few microns, are present. The groove 46 allows the natural elastic memory of the resilient blade material to form the razor-like edge 52 at the first end 50 of the lip 48 with precision lateral straightness of less than a few microns and conform to any irregularities which may be present on the surface 24 of the developing roller 22. The precision straight edge of the blade 12 ensures metering of a single layer of the toner 14 across the developing roller surface 22, preferably reducing, and more preferably eliminating, process direction streaks on the printed document.

It will be appreciated by those skilled in the art that changes could be made to the embodiments described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A blade for metering toner on a developing roller of an electrophotographic printer, the blade being made of a resilient material and comprising:

a first elongated segment;

a second elongated segment extending generally perpendicular to the first segment; and a transition portion connecting the first segment and the second segment, the transition portion having a thickness and a length, the transition portion being generally tangent to a surface of the developing roller, the transition portion including a groove obliquely cut therein in a direction generally opposite from a direction of rotation of the developing roller, the groove forming a movable lip in the transition portion, the lip extending generally toward the second segment a distance approximately one half the thickness of the transition portion, the lip having a length extending the length of the transition portion, the lip contacting toner on the surface of the developing roller proximate to the groove, the lip being elastically displaceable by the toner.

2. The blade according to claim 1, wherein the lip has a first free end including an edge and a second end comprising a part of the transition portion.

3. The blade according to claim 2, wherein the lip contacts the toner on the surface of the developing roller proximate to the edge of the lip.

4. The blade according to claim 3, wherein contact between the lip and the toner on the surface of the developing roller is generally linear contact along the length of the lip.

5. The blade according to claim 2, wherein the developing roller rotates in a direction generally from the second end of the lip toward the first end of the lip.

6. The blade according to claim 1, wherein the resilient material is spring type stainless steel.

* * * * *